United States Patent [19]

Lin

[11] 4,417,941

[45] Nov. 29, 1983

[54] PORTABLE CARTON BOX SEALER WITHOUT TOUCHING THE TAPE BY HAND

[76] Inventor: Yng-Lang Lin, No. 234, Hwai-Teh St., Pan-Chiao, Taiwan

[21] Appl. No.: 270,390

[22] Filed: Jun. 4, 1981

[51] Int. Cl.[3] ..... B32B 35/00

[52] U.S. Cl. ..... 156/475; 156/486; 156/522; 156/577; 156/579

[58] Field of Search ..... 156/468, 475, 486, 522, 156/577, 579

[56] References Cited

U.S. PATENT DOCUMENTS

| | | | |
|---|---|---|---|
| 2,838,195 | 6/1958 | Zito | 156/577 |
| 3,658,628 | 4/1972 | Zevter | 156/579 |
| 3,969,180 | 7/1976 | Revesloot | 156/579 |

*Primary Examiner*—Caleb Weston

*Attorney, Agent, or Firm*—Holman & Stern

[57] ABSTRACT

A hand-held carton sealer comprising a planar frame having a roll of tape associated therewith, means for applying said tape to the surface to be sealed, blade means for cutting said tape when sealing of said surface has been completed and means for locating a portion of the width of the tape over a carton edge.

8 Claims, 2 Drawing Figures

PORTABLE CARTON BOX SEALER WITHOUT TOUCHING THE TAPE BY HAND

BRIEF SUMMARY OF THE INVENTION

This invention relates to a "portable carbon box sealer without touching the tape by hand", of which the structure comprises a " ⊏" frame having three side and able to mount a wheel with axle across said frame. On said wheel a roll of plastic tape is mounted for steadily relating; then a roller is mounted behind said wheel for pressing the plastic tape pull out. In front of said roller bar is furnished to prevent the tape from adhering to the original tape roll, and to prevent the tape from moving towards one side. Behind said roller a saw tooth is furnished for driving their invention moving towards the portion to be sealed sa as to press the tape to the carton box, and to pull out more tape; then, continue to drive this invention moving towards the portion to be sealed, and moving around the carton corners until the carton box being completely sealed. Finally cut off the tape with a saw tooth which is mounted behind said roller.

The object of this invention

Many products have to be packed into a carton box before shipping. Usually, before packing a product, seal the carton box bottom first. The detailed sealing procedures is that intermitently pull out the tape by one hand and adhere it to the carton box by the other hand until the carton box bottom being completely sealed; then put the products in the carton box, and by following the same method of sealing the bottom, seal the upper opening of the carton box. As a result of suing one hand to pull out the tape and using the other hand to press the tape to seal the carton in an intermitent manner. The sealing speed is rather slow. In case of making additional tape seal, such as "†" "⊤" "⊥" or "⊥" shape, etc., more time and man power will be spent, and it means to waste the wage, to increase the cost, and to impose more expenditure on the consumer.

Moreover, in case of requiring timely packing for a fast customs clearance and export, or prompt shipment the conventional slowly sealing method will be unable to meet the aforesaid requirement; consequently, serious losses to both the shipper and the buyer may result. In other words, the aforesaid slowly sealing method (the conventional carton sealing method) must be improved. In view of the facts emotioned above, the inventor has, thru repeated studies, developed the present invention.

Features of this invention

Figure 1:
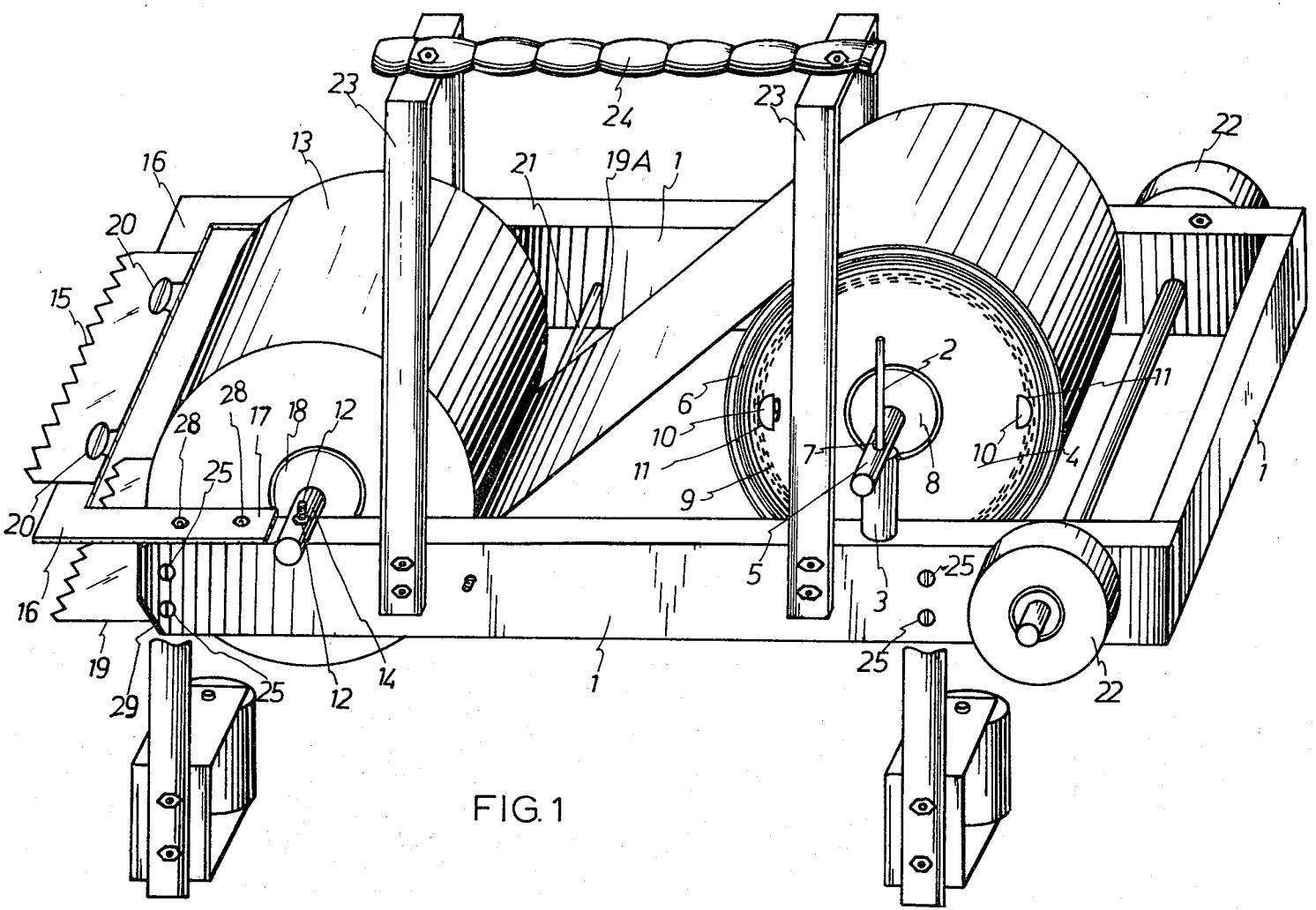

As shown in FIG. 1, No. 1, a ⊏(6) frame having three sides is designed to mount a wheel axle across said frame, of which the size of the corresponding side is 19 cm long, 9 mm depth, and 2.4 cm high); at an appropriate spot is the front top portion of said parallel frame members, a vertical bar is furnished on each said member, as shown in FIG. 1, No. 2, The portion of vertical bar is sleeved with a sleeve (3) having larger diameter for elevating the wheel axle (5) of tape roller (4) as shown in FIG. 1, No. 4, so as to lift up the tape roll (6) to prevent it from touching the carton box during sealing operation. The roller (4) is so fitted with the pierced opening (7) on the ends of the wheel axle (5) extending towards vertical bar (2) insert till to stap the upper end of each sleeve (3) without deviating to left or right, and able to simply assemble or disassemble. Each vertical bar is extending outside the wheel axle (5) or roller (4) about 2.8 cm, as shown in FIG. 1, No. 2. The purpose of designing said extended portion is to prevent the roller from slipping off freely. The roller is designed in various specifications to fit different tape rolls. Said rollers is provided with bearing (8) for smoothly rotaling upon the tape roll being mounted. On one side of said roller, there is flange for retaining the edge of the cardboard ring (9) of tape roll; on the other side, there are two screws (10) with a half-round head of said cardboard ring (11) to preventing the tape roll from deviating to either side. Before mounting tape roll to the roller, rotate said two half-round screws away from their retaining position, and turn them back to the normal actaining position upon the tape roll being mounted. On top side of the appropriate spot of the rear portion of said parallel frame mambers, use screw (12) to fix the two ends (14) of wheel axle of roller pressing right behind the roller; the said screw (12) is also used for docking the saw tooth (15) to fix the saw-tooth mounting (16) and the two ends of opposite side (17), and two ends are integrated under the ends of said wheel axle. The said pressing roller (13) is wider then that of tape roll as to fit various kinds of tape rolls. Said pressing roller (13) is furnished with bearing (18) for smoothly rolling when sealing a carton box, and driving the pressing roller, said pressing roller wiil roll over tape end (19) not adhered to said tape roll (6), and press it to the carboard box. The aforesaid saw tooth (15) is locked to the sawtooth mounting with two screws (20), saw tooth is wider than all kinds of tapes.

At an appropriate spot in front of said pressing roller and the roller (somewhere between said pressing roller and the roller, but near the pressing roller, or right between the pressing roller and said roller) a bar (21) is placed across said ⊏ shapped frame for preventing the tape end (19A) from adhering again with the tape roll (6), and for preventing the said end from deviating to either side. (since a small bar (21), the tape end is adhered to said bar (21), the tape end will not deviate during rolling). Said bar would roll during the tape being pulled out to smooth pulling the tape.

The ⊏ shaped frame is furnished with front wheel (22) for guiding said sealer moving straightwards during sealing. At a suitable spot across the two sides of the frame, a handle frame (23) with appropriate height is mounted for attaching the handle (24). When holding the handle, the user's hand would not touch the tape and the pressing roller so as to conveniently operate this invention.

In order to prevent a sealed carton box being opened by impact or squeeze during shipping, the corner of a carton has to be taped; to do that, attach a half width of the tape to adhere one side of the carton box, and then fold the another carton box, and then fold the another half width of the tape to adher it to the other side of the carton box for completing the sealing work. In doing the aforesaid sealing, one has to pull out the tape with one hand, and to stick to the tape with the other hand, then, the whole sealing work is rather slow.

Figure 2:
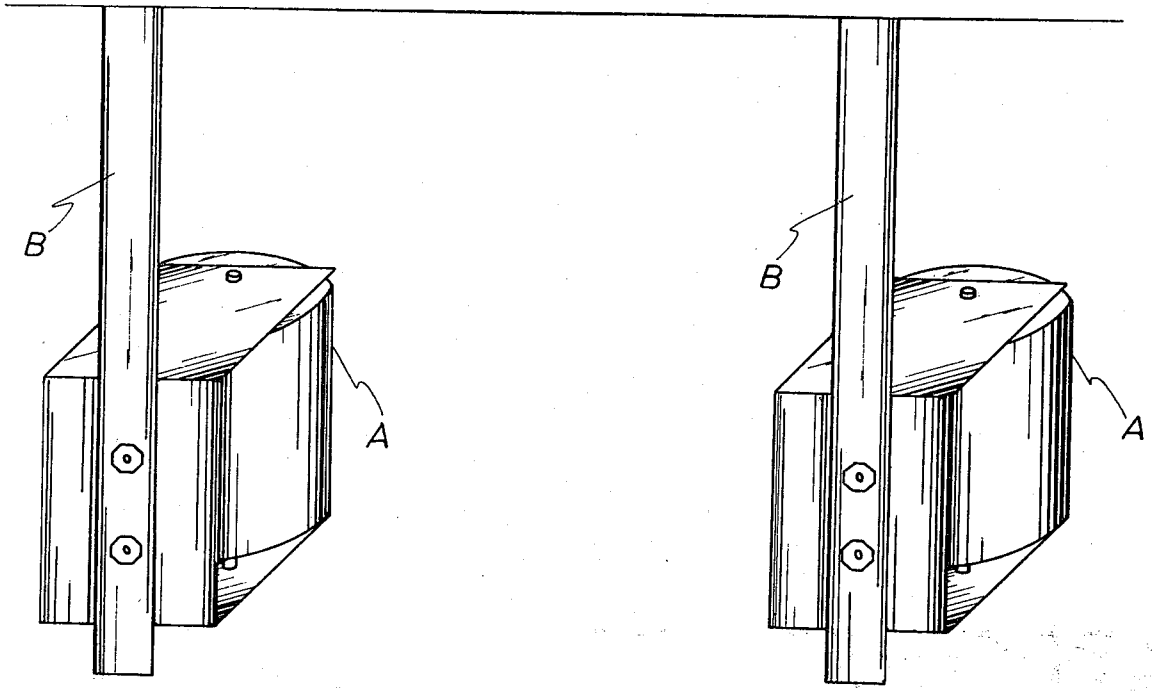

To improve the aforesaid slow operation, the inventor also has developed two pulley-like wheels (A in FIG. 2,), which is designed to seal the carton box corner. When sealing the corner of a carton box. Mount said two pulley-like wheels (A) to this invention, and let it it roll along the carton box edge; as a result only one half width of the pressing roller the tape roll on the roller, and the tape end pulled out can move along the edge of the carton box, and let the another one half of the aforesaid three items extending outside the edge of the carton box. Now by means of said two pulley-like wheels, guide this invention to adhere one half width of the tape, and then press the other half side of the tape to the carton box without touching it by hand.

The said two pulley-like wheels each is furnished with a bar (B in FIG. 2) with two nut holes at its upper end for fastening to an appropriate spot on the [ shapped frame for assembling and disassembling purpose.

The efficiency and advantage of this Invention

Three pratical test by the inventor, this invention is good for all kinds of tape rolls, and for sealing the bottom or the top opening of a carton box, or good for additional reinforcing sealing such as " ┼ ", " ╪ ", " ╫ ", and " ╬ " shapes without touching the tape and box by hand. All you have to do is to mount the tape roll to the roller to detain the cardboard ring in the two half-round head screws, to pull out the out the tape about 14 cm; grasp the handle to haul the space between the pressing roller and the bar going upwards, and with one hand grasp the tape roll and insert the tape end thru the space between the pressing roller and the bar; then, have the pierced opening of the wheel axle end being placed to vertical bar insert until stopping the sleeves, and remove one hand from it. Now, use one hand holding the handle and let the sealer being in vertical position saw tooth underneath). Now, the tape end is also in vertical position naturally and the one side without adhesive will touch the pressing roller that nears the box edge.

First, put the pressing roller to the spot which needs to be sealed; then, the tape end will be adhered to the box edge; then, hole the handle and drive the pressing roller downwards a little to stick said tape end to the box edge, and then drive the pressing roller upwards to pass over box corner, and continue to drive the front wheel for sealing until reaching another box corner; then, let it pass thru the front wheel of the box corner, going downwards along the box edge. As soon as all the length of box edge is covered the open slit of the box is sealed completely and it is the same way to be followed for reinforce seal. Finally, cut off the tape with the saw tooth behind the pressing roller, and a fast sealing is completed satisfactorily.

Material to be used for this invention

General Steel, iron, plastics, rubber, or saw tooth etc.

I claim:

1. A hand-held carton sealer enabling automatic sealing of carton surfaces, comprising:

a planar frame having a roll of tape associated therewith;

means for rotatably supporting said roll of tape at a forward portion of said frame so that tape may be freely pulled therefrom;

means for applying said tape to the surface to be sealed, said applying means being located rearwardly of said tape roll, and said tape being applied to said surface at a location beneath said frame; and blade means disposed at a rearward portion of said frame for cutting the tape when sealing of said surface has been completed;

said frame further including means for locating a portion of the width of the tape over a carton edge, said locating means being carried below and within said frame.

2. The sealer of claim 1, wherein said locating means is detachable, and comprises spaced wheel means depending from one side of said frame, said wheel means rolling in a plane normal to the plane of said frame, whereby said wheel means roll along the edge of the carton normal to the edge along which the tape is being applied when a carton corner is being sealed.

3. The sealer of claim 1, wherein said frame includes a pair of posts projecting upwardly therefrom and said means for supporting comprise roller means mounted on said posts.

4. The sealer of claim 3, wherein said supporting means further comprises a bearing having opposing axles, each axle including diametrically opposed apertures therethrough for receipt on a corresponding post, and each said post including a sleeve mounted thereon adjacent said frame, said axles resting on said sleeves when said roll of tape is mounted on said frame.

5. The sealer of claim 1, wherein said applying means comprises means for pressing the tape against the carton surface to be sealed, said pressing means bearing against said tape at a position below the frame.

6. The sealer of claim 5, wherein said applying means further comprises a rollable means, positioned below said tape and between said supporting means and said pressing means, for preventing tape pulled from the roll from adhering back on the roll.

7. The sealer of claim 1, wherein said blade means is disposed parallel to the plane of the frame and positioned rearwardly of said frame.

8. The sealer of claim 7, including means for mounting said blade means, said frame including opposing pins on which are mounted said applying means and said mounting means.

* * * * *